US010294788B2

(12) United States Patent
Stankus et al.

(10) Patent No.: US 10,294,788 B2
(45) Date of Patent: May 21, 2019

(54) SLOTTED TUBULAR ANCHOR

(71) Applicant: FCI Holdings Delaware, Inc., Wilmington, DE (US)

(72) Inventors: John C. Stankus, Canonsburg, PA (US); Dakota Faulkner, New Kensington, PA (US); David Rager, McKeesport, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 15/657,676

(22) Filed: Jul. 24, 2017

(65) Prior Publication Data

US 2018/0023391 A1 Jan. 25, 2018

Related U.S. Application Data

(60) Provisional application No. 62/366,345, filed on Jul. 25, 2016.

(51) Int. Cl.
*E21D 21/00* (2006.01)
*E21D 20/00* (2006.01)

(52) U.S. Cl.
CPC ..... *E21D 21/008* (2013.01); *E21D 20/00* (2013.01); *E21D 21/0053* (2016.01)

(58) Field of Classification Search
CPC ..... E21D 20/00
USPC ..... 405/259.1, 259.3
See application file for complete search history.

(56) References Cited

U.S. PATENT DOCUMENTS 4,289,426 A * 9/1981 Chaiko ..... E21D 21/008 405/259.1
4,310,266 A 1/1982 Malsbury et al.
4,806,053 A * 2/1989 Herb ..... F16B 13/065 405/259.3
2012/0163924 A1* 6/2012 Rataj ..... E21D 21/0033 405/259.3

* cited by examiner

*Primary Examiner* — Sean D Andrish
(74) *Attorney, Agent, or Firm* — The Webb Law Firm

(57) ABSTRACT

A mine bolt includes an elongated body having a first end and a second end positioned opposite the first end, and an anchor comprising a tube defining a central opening and a slot extending at least a portion of the length of the tube. The anchor is secured to the elongated body. The anchor is configured to compress upon installation of the mine bolt to anchor the elongated body within a bore hole.

10 Claims, 7 Drawing Sheets

SLOTTED TUBULAR ANCHOR

CROSS REFERENCE TO RELATED APPLICATIONS

This application claims the benefit of U.S. Provisional Patent Application No. 62/366,345, filed Jul. 25, 2016, the entire content of which is hereby incorporated by reference.

BACKGROUND OF THE INVENTION

Field of the Invention

This invention is related to a mine bolt and, more particularly, to a mine bolt having an anchor for securing the mine bolt within a bore hole.

Description of Related Art

The roof/ribs of a mine are conventionally supported by tensioning the roof with steel bolts inserted into bore holes drilled in the mine roof that reinforces the unsupported rock formation above the mine roof. The end of the mine roof bolt may be anchored mechanically to the rock formation by engagement of an expansion assembly on the end of the mine roof bolt with the rock formation. Alternatively, the mine roof bolt may be adhesively bonded to the rock formation with a resin bonding material or a grout inserted or pumped into the bore hole. A combination of mechanical anchoring and resin bonding can also be employed by using both an expansion assembly and resin bonding or grout material.

A mechanically anchored mine roof bolt typically includes an expansion assembly threaded onto one end of the bolt shaft and a drive head for rotating the bolt. A mine roof plate is positioned between the drive head and the mine roof surface. The expansion assembly generally includes a multi-prong shell supported by a threaded ring and a plug threaded onto the end of the bolt. When the prongs of the shell engage with rock surrounding a bore hole, and the bolt is rotated about its longitudinal axis, the plug threads downwardly on the shaft to expand the shell into tight engagement with the rock thereby placing the bolt in tension between the expansion assembly and the mine roof surface.

A further type of mine roof bolt utilizes a slotted steel tube, which is inserted into the bore hole such that the slotted steel tube is compressed to provide radial and axial restraint to rock movement.

SUMMARY OF THE INVENTION

In one aspect, a mine bolt includes an elongated body having a first end and a second end positioned opposite the first end, and an anchor comprising a tube defining a central opening and a slot extending at least a portion of the length of the tube. The anchor is secured to the elongated body. The anchor is configured to compress upon installation of the mine bolt to anchor the elongated body within a bore hole.

The anchor may include a nut secured to the tube and positioned within the central opening, with the elongated body having a threaded portion configured to be received by the nut. The nut may be welded to the tube. The threaded portion may be positioned at the first end of the elongated body. The anchor may include a tapered first end and a second end positioned opposite the tapered first end. The second end of the anchor may define a plurality of slits configured to engage a bore hole wall when the mine bolt is installed and placed under loading. The tapered first end may define a slit. The anchor may extend from the first end of the elongated body to a position intermediate the first end and the second end of the elongated body. The elongated body may be axially and rotationally moveable relative to the anchor. The second end of the elongated body may include a drive head. The mine bolt may further include a bearing plate configured to receive the elongated body. The anchor may include an unthreaded nut secured to the tube and positioned within the central opening, with the elongated body having first and second support nuts received by a threaded position of the elongated body, and with the first and second support nuts configured to restrict the axial movement of the elongated body relative to the unthreaded nut and the anchor.

In a further aspect, a method of installing a mine bolt includes providing a mine bolt including an elongated body having a first end and a second end positioned opposite the first end, and an anchor comprising a tube defining a central opening and a slot extending at least a portion of the length of the tube, with the anchor secured to the elongated body. The method further including inserting the mine bolt into a bore hole with the anchor compressing as the anchor is inserted into the bore hole.

The mine bolt may be inserted into the bore hole until the second end of the elongated body is positioned at an opening of the bore hole. The method may further include providing a bearing plate that receives the elongated body, and tensioning the mine bolt by rotating the elongated body about a longitudinal axis to move the elongated body axially relative to the anchor.

The anchor may include a nut secured to the tube and positioned within the central opening, with the elongated body having a threaded portion received by the nut. The second end of the elongated body may include a drive head, with the elongated body being rotated by engaging the drive head of the elongated body. The anchor may include a tapered first end and a second end positioned opposite the tapered first end, with the tapered first end being the first portion of the mine bolt inserted into the bore hole. The elongated body may include a drill bit. The anchor may include an unthreaded nut secured to the tube and positioned within the central opening, with the elongated body having first and second support nuts received by a threaded position of the elongated body, and with the first and second support nuts configured to restrict the axial movement of the elongated body relative to the unthreaded nut and the anchor.

DESCRIPTION OF THE PREFERRED EMBODIMENTS

Figure 1:
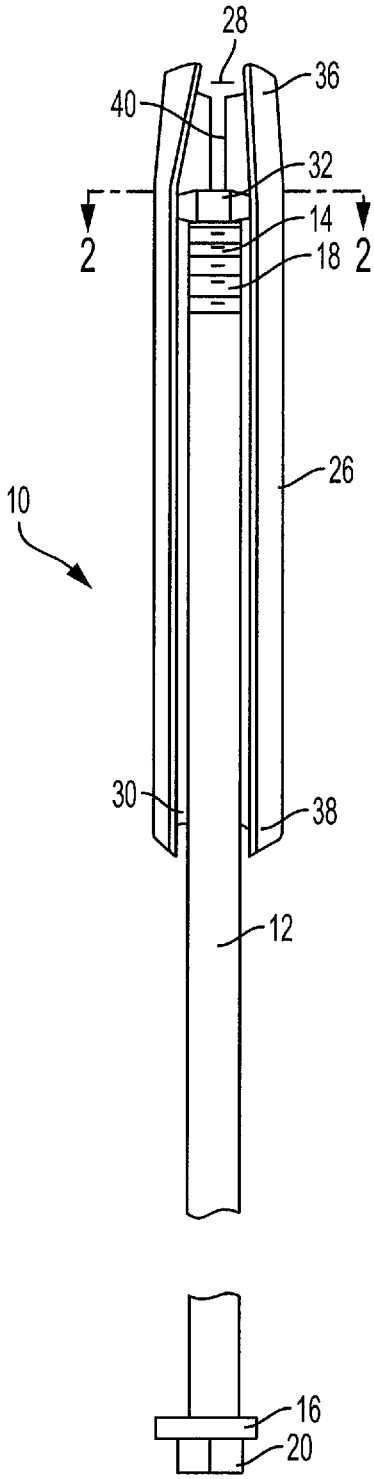
FIG. 1 is a front perspective view of a mine bolt according to one aspect of the present invention.
Figure 2:
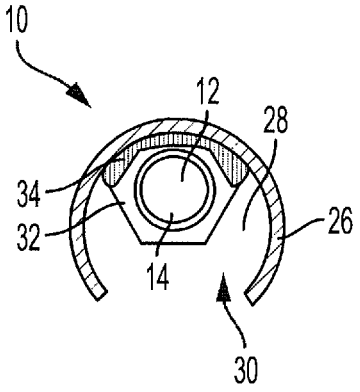
FIG. 2 is a cross-sectional view along line 2-2 shown in FIG. 1.

The present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Referring to FIGS. 1-10, a mine bolt 10 according to one aspect of the present invention includes an elongated body 12 having a first end 14 and a second end 16 positioned opposite the first end 14. The first end 14 of the elongated body 12 includes a threaded portion 18. The second end 16 of the elongated body 12 includes a drive head 20, which may be formed integrally with the elongated body 12 or may be provided as a nut that is threaded onto the second end 16 of the elongated body 12. The elongated body 12 may be made of steel, although other suitable materials may be utilized. The elongated body 12 may be smooth or deformed bars with UNC or metric threads, such as rebar or J-Bar commercially available from Jennmar. The elongated body 12 may also be hollow or solid core bar with rope thread (R32) or hot rolled threaded bar, such as the JM threaded bar commercially available from Jennmar. The mine bolt 10 also includes an anchor 26 formed by a tube that defines a central opening 28 and a slot 30 that extends the length of the anchor 26, although the slot 30 may only extend a portion of the length of the anchor 26.

As discussed in more detail below, the anchor 26 is configured to secure the elongated body 12 within a bore hole. The anchor 26 further includes a nut 32 secured to the anchor 26 and positioned within the central opening 28. The threaded portion 18 of the elongated body 12 is threaded into the nut 32 to secure the elongated body 12 to the anchor 26. The nut 32 is secured to the anchor 26 via a weld 34, although any other suitable mechanical fastening may be utilized. Furthermore, although the nut 32 is utilized, any other suitable arrangement for securing the elongated body 12 to the anchor 26 may be utilized. The anchor 26 includes a tapered first end 36 and a second end 38 positioned opposite the tapered first end 36. The tapered first end 36 has a smaller diameter than the remaining portion of the anchor 26. The tapered first end 36 of the anchor 26 allows the anchor 26 to be inserted into the bore hole with the anchor 26 radially compressing as the anchor 26 is inserted into the bore hole thereby providing a radial force to secure the mine bolt 10 within the bore hole. In other words, when the anchor 26 is radially compressed, the anchor 26 wants to return to its original position thereby providing a biasing force radially outward. The first end 36 of the anchor 26 may define at least one slit 40 to facilitate providing the taper of the first end 36 during manufacture of the anchor 26. The slit 40 may extend for part of or the entire tapered portion of the first end 36 of the anchor 26. As shown in FIGS. 2 and 6-9, the nut 32 is secured to one side of the anchor 26 such that the anchor 26 is still free to compress and move with the irregularities of the bore hole during installation of the mine bolt 10. The diameter of the nut 32 is smaller than the diameter of the central opening 28 of the anchor 26. The extent to which the nut 32 is attached (e.g. welded) to the anchor 26 impacts the degree to which the anchor 26 can compress radially. As such, minimizing the attachment area between the nut 32 and the anchor 26 will increase the amount of flex and "spring" in the anchor 26. However, the nut 32 must be sufficiently attached to a degree such that upon loading of the mine bolt 10, the nut 32 remains fixed to the anchor 26. In one aspect, 40-50% of the circumference of the nut 32 is welded to the anchor 26.

Figure 3:
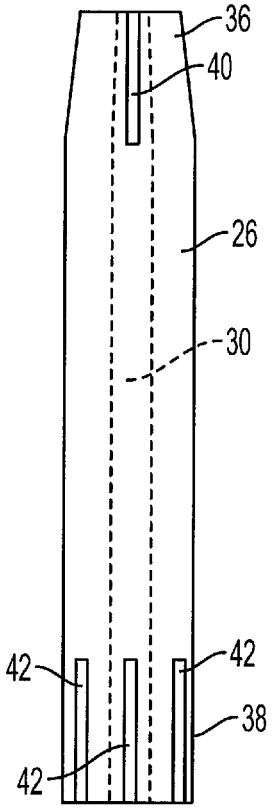
FIG. 3 is a front view of an anchor for a mine bolt according to one aspect of the present invention.

Referring to FIG. 3, the second end 38 of the anchor 26 may further include a plurality of slits 42 configured to engage rock strata when the mine bolt 10 is installed in a bore hole and placed under loading. The slits 42 extend from the second end 38 of the anchor 26 to a position intermediate the first 36 and second end 38 of the anchor. Although not shown, the second end 38 of the anchor 26 may also be flared radially outward to further ensure the anchor 26 engages the rock strata defining the bore hole. The slits 42 may be configured to allow the second end 38 of the anchor 26 to be flared radially outward.

Figure 4:
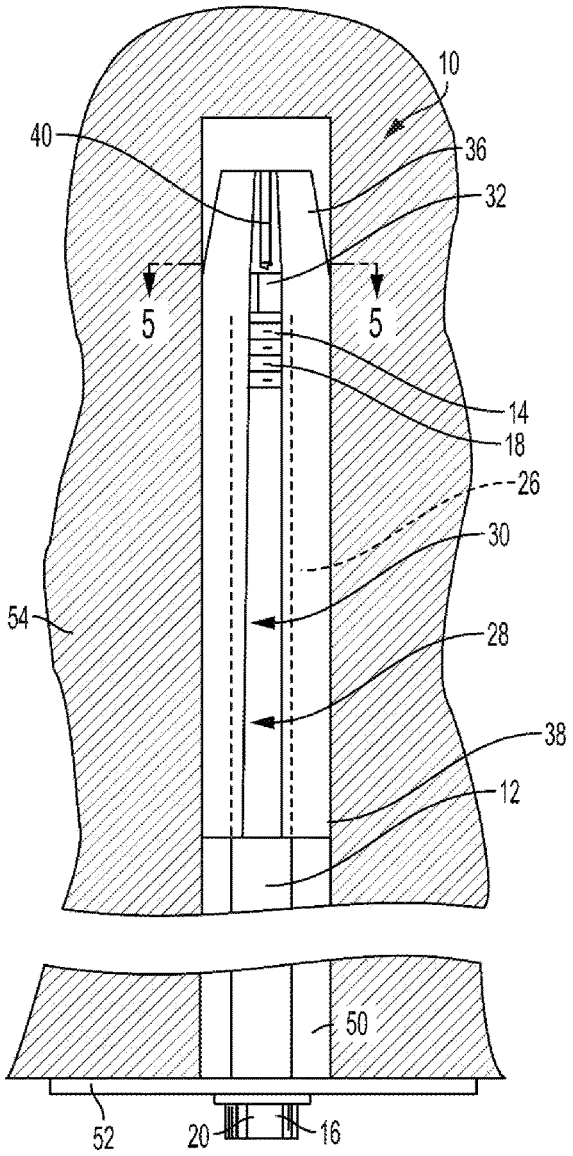
FIG. 4 is front view of the mine bolt of FIG. 1, showing the mine bolt installed in a bore hole.
Figure 5:
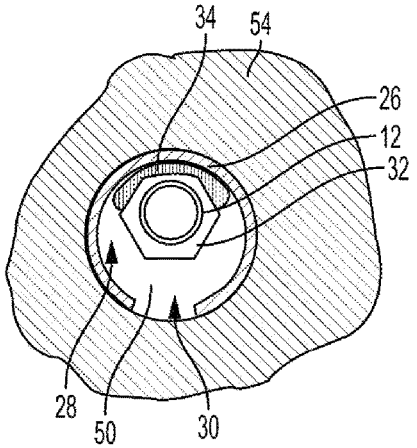
FIG. 5 is a cross-sectional view along line 5-5 shown in FIG. 4.
Figure 6:
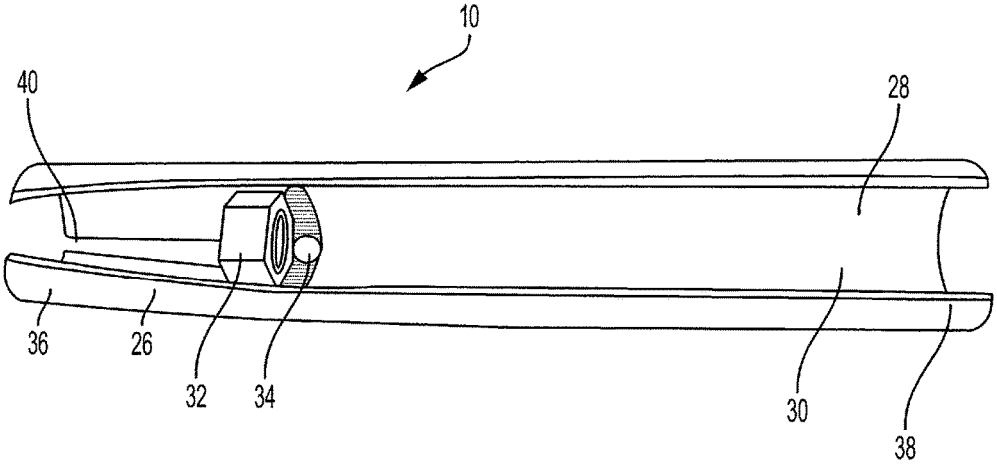
FIG. 6 is a front perspective view of an anchor for a mine bolt according to one aspect of the present invention.
Figure 7:
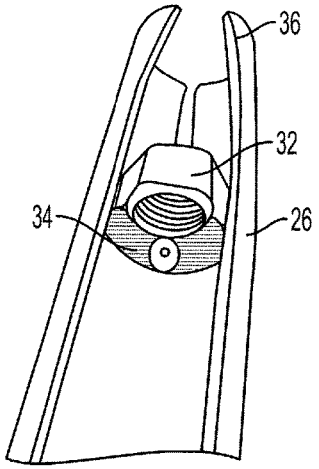
FIG. 7 is an enlarged front perspective view of the anchor of FIG. 6.
Figure 8:
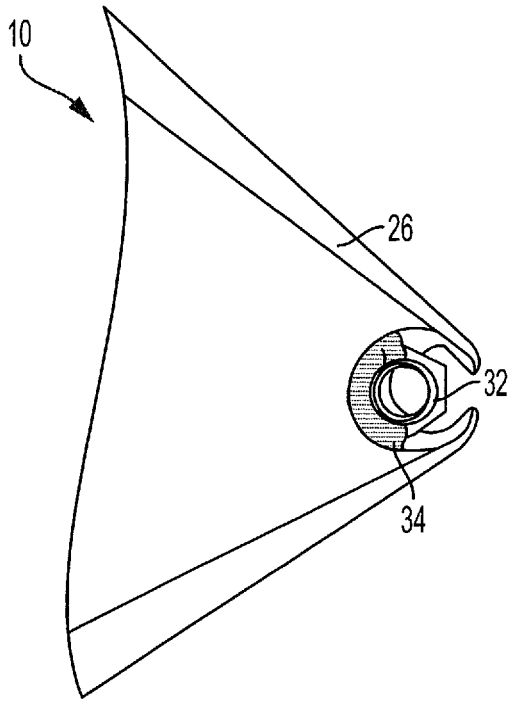
FIG. 8 is a bottom perspective view of the anchor of FIG. 6.
Figure 9:
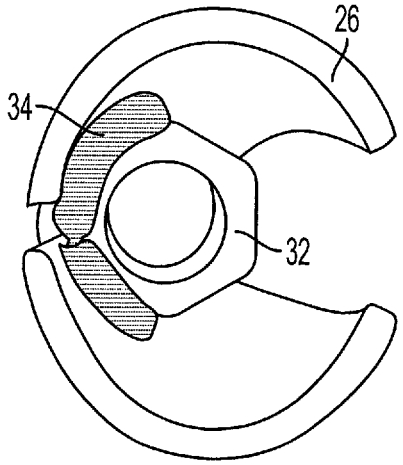
FIG. 9 is a top perspective view of the anchor of FIG. 6.
Figure 10:
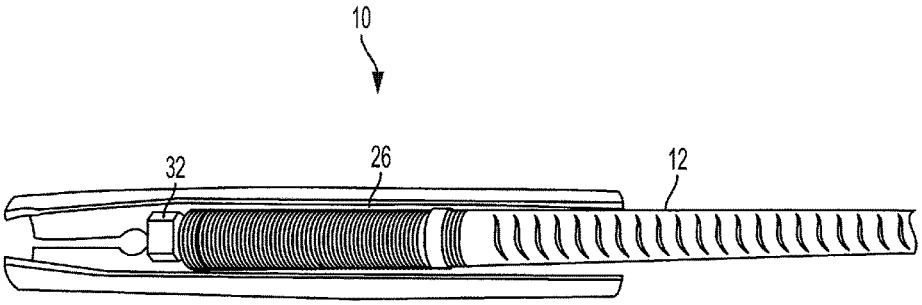
FIG. 10 is a front perspective view of a mine bolt according to one aspect of the present invention.

Referring to FIGS. 4 and 5, the mine bolt 10 is shown installed in a bore hole 50. The mine bolt 10 is shown installed with a bearing plate 52, although other suitable arrangements may be utilized. In particular, the mine bolt 10 may further include a corrosion protection sleeve and may also be configured to be grouted during installation. As shown in FIG. 5, the anchor 26 engages rock strata 54 defining the bore hole 50 with the outwardly biasing force of the anchor 26 securing the anchor 26 and the elongated body 12 within the bore hole 50. In other words, the compression of the anchor 26 secures the anchor 26 within the bore hole 50 to withstand axial and radial forces with the elongated body 12 secured to the anchor 26 via the nut 32. The anchor 26 is compressed as the anchor 26 is inserted into the bore hole 50 with the tapered first end 36 of the anchor 26 being the first position of the mine bolt 10 inserted into the bore hole. Upon loading, the second end 38 of the anchor 26 may be configured to engage the rock strata 54 by providing the plurality of slits 42, serrations (not shown), and/or flaring the second end 38 of the anchor 26. After being anchored, the mine bolt 10 may be tensioned by rotating the drive head 20 to rotate the elongated body 12 about its longitudinal axis relative to the nut 32 and the anchor 26 such that the bearing plate 52 engages the rock strata 54 adjacent to the opening of the bore hole 50. The mine bolt 10 is inserted into the bore hole 50 until the second end 16 of the elongated body 12 is positioned at an opening of the bore hole 50.

Figure 11:
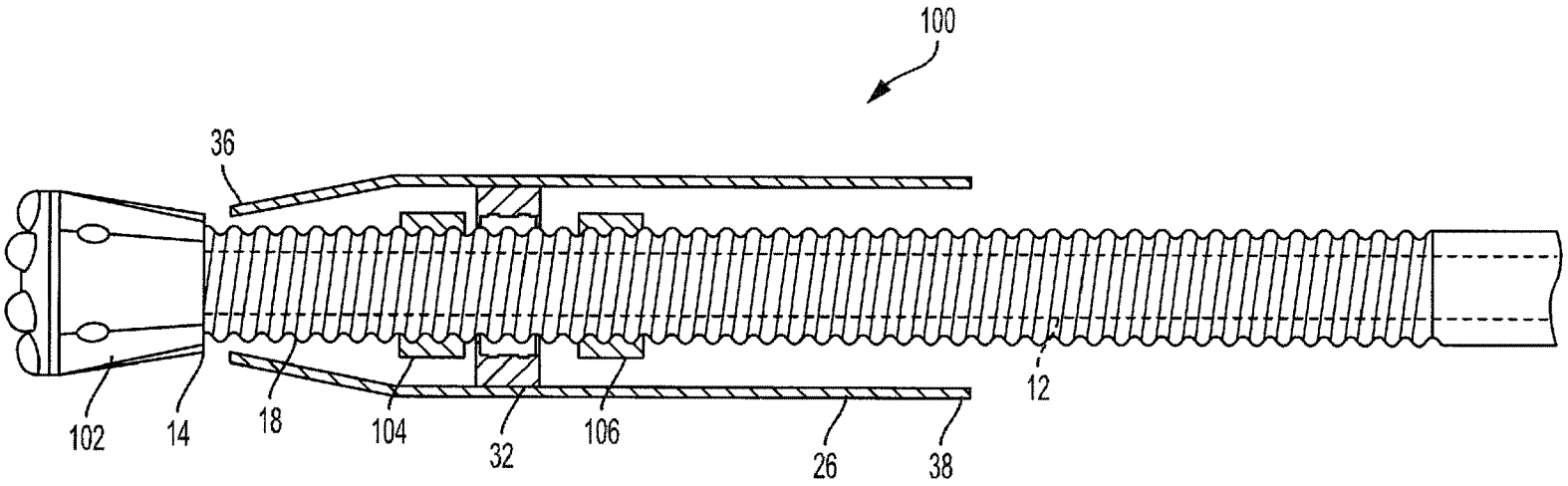
FIG. 11 is a partial cross-sectional view of a mine bolt according to a further aspect of the present invention.

Referring to FIG. 11, a mine bolt 100 according to a further aspect of the present invention is shown. The mine bolt 100 is similar to the mine bolt shown in FIGS. 1-10 discussed above. The mine bolt 100, however, is a self-drilling bolt and includes a drill bit 102 secured to the first end 14 of the elongated body 12. The drill bit 102 may be threaded onto the threaded portion 18 of the second end, although other suitable securing arrangements may be utilized. Further, in order to allow the drill bit 102 to drill the bore hole 50 in the rock strata 54, the first end 14 of the elongated body 12 and the drill bit 102 are positioned outside of the anchor 26 and extend beyond the first end 36 of the anchor 26. The nut 32 of the mine bolt 100 is secured to the anchor 26 in the same manner as described above in connection with the mine bolt 10 shown in FIGS. 1-10. The nut 32 of the mine bolt 100, however, is unthreaded to allow the elongated body 12 to rotate independently from the nut 32 and the anchor 26. The axial position of the elongated body 12 is fixed by first and second support nuts 104, 106 positioned on each side of the nut 32. The support nuts 104, 106 are threaded onto the threaded portion 18 of the elongated body 12 with the first support nut positioned closer to the first end 14 of the elongated body 12 relative to the nut 32 and the second support nut position closer to the second end 16 of the elongated body 12. Accordingly, the first and second support nuts 104, 106 fix the axial location of the elongated body 12 relative to the nut 32 and the anchor 26 while allowing the elongated body 12 and drill bit 102 to rotate independently from the nut 32 and anchor 26 during a drilling operation using the mine bolt 100.

The anchor 26 of the mine bolt 100 operates in the same manner as discussed above in connection with the mine bolt 10 shown in FIGS. 1-10. In particular, the drill bit 102 drills the bore hole 50 in the rock strata 54 by rotating the elongated body 12 with the anchor 26 being compressed as the anchor 26 enters the bore hole 50 drilled by the drill bit 102. The anchor 26 continues to advance within the bore hole 50 as the drilling process continues. Upon reaching the desired bore hole 50 depth, the drill process ceases with the drill bit 102 remaining in the bore hole 50 and the anchor 26 securing the mine bolt 100 within bore hole 50. The mine bolt 100 may be tensioned in the same manner as mine bolt 10.

While several embodiments were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A mine bolt comprising:

an elongated body having a first end and a second end positioned opposite the first end; and an anchor comprising a tube defining a central opening and a slot extending at least a portion of a length of the tube, the anchor is secured to the elongated body, wherein:

the anchor is configured to compress upon installation of the mine bolt to anchor the elongated body within a bore hole;

the anchor comprises a nut with an outer diameter, the nut is welded to the tube and positioned within the central opening, the elongated body having a threaded portion configured to be received by the nut; and the outer diameter of the nut being smaller than a diameter of the central opening of the anchor.

2. The mine bolt of claim 1, wherein the threaded portion is positioned at the first end of the elongated body.

3. The mine bolt of claim 1, wherein the anchor includes a tapered first end and a second end positioned opposite the tapered first end.

4. The mine bolt of claim 3, wherein the tapered first end defines a slit.

5. The mine bolt of claim 1, wherein the anchor extends from the first end of the elongated body to a position intermediate the first end and the second end of the elongated body.

6. The mine bolt of claim 1, wherein the second end of the elongated body comprises a drive head.

7. The mine bolt of claim 1, further comprising a bearing plate configured to receive the elongated body.

8. The mine bolt of claim 1, wherein the nut is hexagonal in shape.

9. A mine bolt comprising:

an elongated body having a first end and a second end positioned opposite the first end; and an anchor comprising a tube defining a central opening and a slot extending at least a portion of a length of the tube, the anchor is secured to the elongated body, wherein:

the anchor is configured to compress upon installation of the mine bolt to anchor the elongated body within a bore hole;

the anchor comprises a nut with an outer diameter, the nut is secured to the tube and positioned within the central opening, the elongated body having a threaded portion configured to be received by the nut;

the outer diameter of the nut being smaller than a diameter of the central opening of the anchor;

the anchor includes a tapered first end and a second end positioned opposite the tapered first end; and the second end of the anchor defines a plurality of slits configured to engage a bore hole wall when the mine bolt is installed and placed under loading.

10. A mine bolt comprising:

an elongated body having a first end and a second end positioned opposite the first end; and an anchor comprising a tube defining a central opening and a slot extending at least a portion of a length of the tube, the anchor is secured to the elongated body, wherein:

the anchor is configured to compress upon installation of the mine bolt to anchor the elongated body within a bore hole;

the anchor comprises a nut with an outer diameter, the nut is secured to the tube and positioned within the central opening, the elongated body having a threaded portion configured to be received by the nut;

the outer diameter of the nut being smaller than a diameter of the central opening of the anchor; and 40-50% of an outer circumference of the nut is welded to the tube.

* * * * *